US011649822B2

(12) United States Patent
DeHoff et al.

(10) Patent No.: US 11,649,822 B2
(45) Date of Patent: May 16, 2023

(54) SPLIT POWER GEROTOR PUMP

(71) Applicant: Schaeffler Technologies AG & Co. KG, Herzogenaurach (DE)

(72) Inventors: Kyle DeHoff, Canal Fulton, OH (US); Chris Luipold, Wadsworth, OH (US); Jeffrey Hemphill, Copley, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 145 days.

(21) Appl. No.: 17/169,629

(22) Filed: Feb. 8, 2021

(65) Prior Publication Data

US 2022/0252066 A1 Aug. 11, 2022

(51) Int. Cl.

| | |
|---|---|
| ***F04C 2/10*** | (2006.01) |
| ***F04C 2/08*** | (2006.01) |
| ***F04C 14/22*** | (2006.01) |
| ***F04D 13/06*** | (2006.01) |
| ***F04C 2/12*** | (2006.01) |

(52) U.S. Cl.

CPC ..... *F04C 2/126* (2013.01); *F04C 2/08* (2013.01); *F04C 2/10* (2013.01); *F04C 2/102* (2013.01); *F04D 13/06* (2013.01); *F04C 2240/10* (2013.01); *F04C 2240/20* (2013.01); *F04C 2240/40* (2013.01); *F04C 2240/50* (2013.01); *F04C 2240/60* (2013.01)

(58) Field of Classification Search

CPC ..... F04C 2/106; F04C 2/102; F04C 14/22; F04C 2/08; F04C 2/10; F04D 13/06

See application file for complete search history.

(56) References Cited

U.S. PATENT DOCUMENTS

| | | | | |
|---|---|---|---|---|
| 6,174,151 | B1 * | 1/2001 | Yarr | F01C 1/103 418/61.3 |
| 10,072,660 | B2 | 9/2018 | Bohm | |
| 2008/0240960 | A1 * | 10/2008 | Hodge | F04C 14/22 418/61.3 |
| 2011/0200477 | A1 | 8/2011 | Chua | |
| 2017/0328362 | A1 | 11/2017 | Hemphill | |
| 2021/0048022 | A1 | 2/2021 | DeHoff et al. | |
| 2022/0252067 | A1 | 8/2022 | Hrusch et al. | |

FOREIGN PATENT DOCUMENTS

| | | | | |
|---|---|---|---|---|
| DE | 102016213611 | A1 * | 1/2018 | F04C 2/102 |
| EP | 1840327 | A2 | 10/2007 | |
| GB | 2430237 | A * | 3/2007 | F01C 17/02 |
| JP | 2008057444 | A | 3/2008 | |
| JP | 2013241838 | A | 12/2013 | |
| JP | 2019196722 | A | 11/2019 | |

OTHER PUBLICATIONS

English GB 2430237 by PE2E.*

* cited by examiner

*Primary Examiner* — Deming Wan

(57) ABSTRACT

A split power gerotor pump includes a rotational axis, a shaft, an inner gerotor, an eccentric pocket, and an outer gerotor. The inner gerotor is rotationally fixed on the shaft, rotatable about the rotational axis, and includes n first lobes. The eccentric pocket is rotatable about the rotational axis, and includes a cylindrical bore with a center radially offset from the rotational axis and an outer surface, disposed radially outside of the cylindrical bore and arranged for direct engagement with a gear or a rotor for an electric motor. The outer gerotor includes a cylindrical outer surface installed in the cylindrical bore and n+1 second lobes.

18 Claims, 2 Drawing Sheets

SPLIT POWER GEROTOR PUMP

TECHNICAL FIELD

The present disclosure relates generally to a gerotor pump, and more specifically to a split power gerotor pump.

BACKGROUND

Split power gerotor pumps are known. One example is shown and described in U.S. Pat. No. 10,072,660 titled PUMPING DEVICE FOR PUMPING OIL FROM A STORAGE CONTAINER TO A TRANSMISSION SYSTEM OF A MOTOR VEHICLE to Böhm.

SUMMARY

Example embodiments broadly comprise a split power gerotor pump including a rotational axis, a shaft, an inner gerotor, an eccentric pocket, and an outer gerotor. The inner gerotor is rotationally fixed on the shaft, rotatable about the rotational axis, and includes n first lobes. The eccentric pocket is rotatable about the rotational axis, and includes a cylindrical bore with a center radially offset from the rotational axis and an outer surface, disposed radially outside of the cylindrical bore and arranged for direct engagement with a gear or a rotor for an electric motor. The outer gerotor includes a cylindrical outer surface installed in the cylindrical bore and n+1 second lobes.

In some example embodiments, the split power gerotor pump includes a first port plate fixed to the eccentric pocket on a first axial side and a second port plate fixed to the eccentric pocket on a second axial side, opposite the first axial side. The first port plate has a first orifice for directing a hydraulic fluid into a gap between a one of the n first lobes and a one of the n+1 second lobes, and the second port plate has a second orifice for receiving the hydraulic fluid after relative rotation between the inner gerotor and the outer gerotor compresses the gap. In some example embodiments, a one of the first port plate or the second port plate is integrally formed with the eccentric pocket from a same piece of material. In an example embodiment, the split power gerotor pump has a first seal that seals a first annular face of the other one of the first port plate or the second port plate to a second annular face of the eccentric pocket.

In some example embodiments, the split power gerotor pump has a housing with a collection chamber hydraulically connected to the first orifice and arranged for hydraulic connection to a hydraulic sump. In an example embodiment, the shaft extends through an axial entirety of the collection chamber. In some example embodiments, the split power gerotor pump includes an outlet cover fixed to the second port plate and a second seal disposed between the outlet cover and the second port plate for sealing the outlet cover to the second port plate. The outlet cover has a tubular protrusion concentric with the rotational axis for expelling the hydraulic fluid. In an example embodiment, the split power gerotor pump includes a first bearing installed on the tubular protrusion. The outlet cover has a cylindrical protrusion, the second port plate has a cylindrical bore, and the cylindrical protrusion is installed in the cylindrical bore for radially positioning the second port plate relative to the outlet cover.

In some example embodiments, the split power gerotor pump includes a second bearing installed in the eccentric pocket for rotatably supporting the shaft. In some example embodiments, the split power gerotor pump includes a housing and a third bearing installed in the housing for rotatably supporting the eccentric pocket. In an example embodiment, the split power gerotor pump includes a third seal installed in the eccentric pocket axially between the third bearing and the outer gerotor for sealing the eccentric pocket to the housing.

In some example embodiments, the split power gerotor pump includes a housing and an electric motor. In some example embodiments, the electric motor is fixed to the housing and drivingly engaged with the shaft. In an example embodiment, the split power gerotor pump includes a fourth seal for sealing seal the housing to the electric motor. In an example embodiment, the outer surface of the eccentric pocket has a toothed profile arranged for direct engagement with the gear.

In some example embodiments, the electric motor has a stator rotationally fixed to the housing and including a plurality of stator coils, and the rotor rotationally fixed to the outer surface of the eccentric pocket. In an example embodiment, the stator is a magnetic stator and the rotor is a magnetic rotor. In an example embodiment, a straight line extending radially outward from the rotational axis passes through, in order, the inner gerotor, the outer gerotor, the rotor and the stator.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
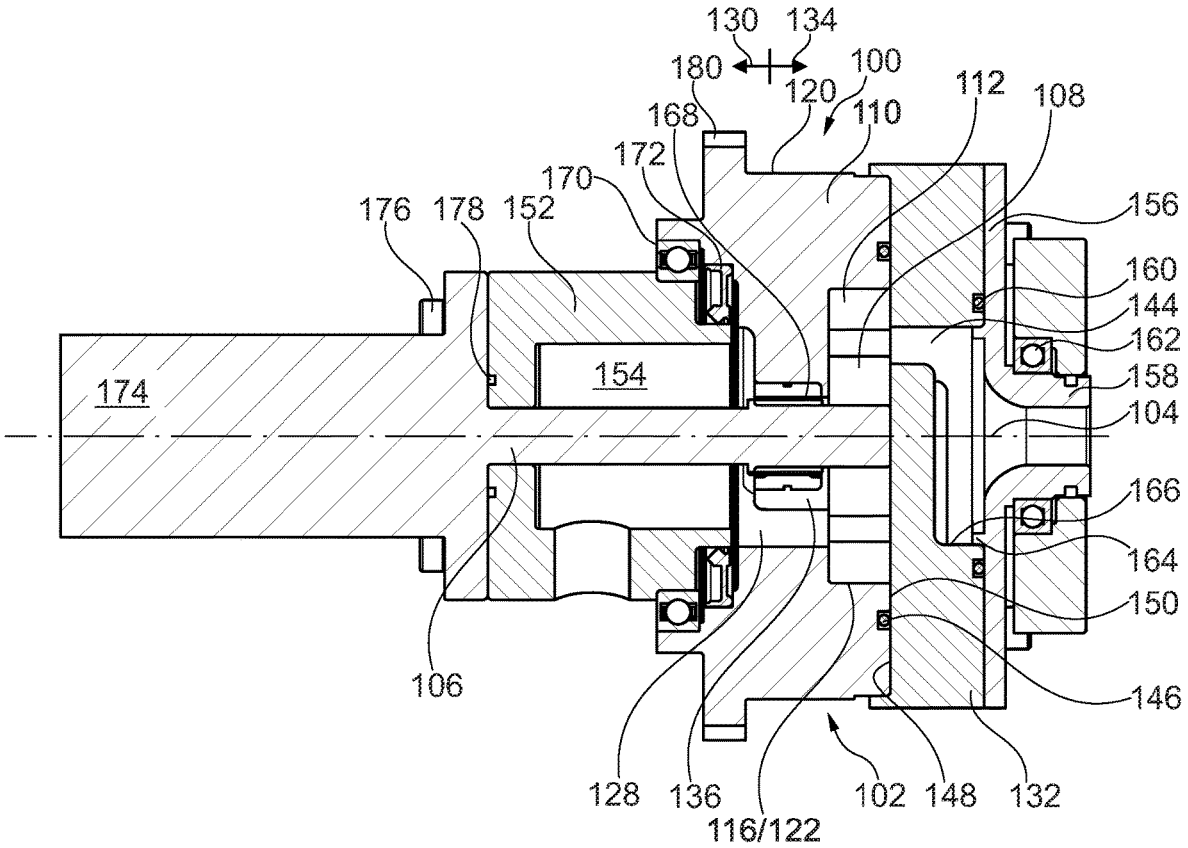
FIG. 1 illustrates a cross-sectional view of a first embodiment of a split power gerotor pump according to an example aspect of the present disclosure.
Figure 2:
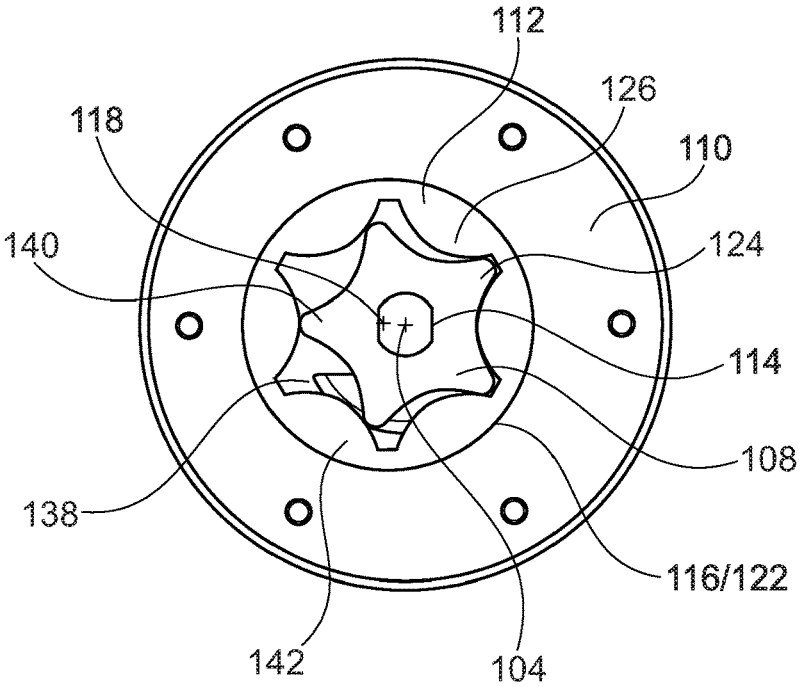
FIG. 2 illustrates front view of a gerotor pump assembly of the split power gerotor pump of FIG. 1.

The following description is made with reference to FIGS. 1-2. FIG. 1 illustrates a cross-sectional view of split power gerotor pump 100 according to an example aspect of the present disclosure. FIG. 2 illustrates a front view of gerotor pump assembly 102 of the split power gerotor pump of FIG. 1. Split power gerotor pump 100 includes rotational axis 104, shaft 106, inner gerotor 108, eccentric pocket 110 and outer gerotor 112. Gerotor pump assembly 102 includes the inner gerotor, eccentric pocket and outer gerotor as shown in FIG. 2.

The inner gerotor is rotationally fixed on the shaft by ground flats 114 (ref. FIG. 2), although other methods (e.g., spline, press-fit, welding, etc.) could be employed. The eccentric pocket is rotatable about rotational axis 104 and includes cylindrical bore 116 with center 118 radially offset from that rotational axis. The eccentric pocket also includes outer surface 120 disposed radially outside of the cylindrical bore. The outer surface is arranged for direct engagement with a gear or an electric motor as described below. The outer gerotor includes cylindrical outer surface 122 installed in cylindrical bore 116. As best shown in FIG. 2, inner gerotor 108 includes 5 lobes 124 and outer gerotor 112 includes 6 lobes 126 for moving a hydraulic fluid through pump assembly 102 as described below. In other words, if the inner gerotor has n lobes 124, then the outer gerotor has n+1 lobes 126.

Port plate 128 is fixed to eccentric pocket 110 on axial side 130, and port plate 132 is fixed to eccentric pocket 110 on axial side 134, opposite axial side 130. Port plate 128 includes orifice 136 for directing the hydraulic fluid into gap 138 between lobe 140 and lobe 142, and port plate 132 includes orifice 144 for receiving the hydraulic fluid after relative rotation between the inner gerotor and the outer gerotor compresses the gap. In the embodiment shown in FIG. 1, port plate 128 is integrally formed with the eccentric pocket from a same piece of material. Other embodiments (not shown) may include port plate 132 integrally formed with the eccentric pocket, however.

Seal 146 seals annular face 148 of port plate 132 to annular face 150 of the eccentric pocket. Housing 152 includes collection chamber 154 hydraulically connected to orifice 128 and arranged for hydraulic connection to a hydraulic sump (not shown). As shown in FIG. 1, shaft 106 extends through an axial entirety of collection chamber 154.

Outlet cover 156 is fixed to port plate 132 and includes tubular protrusion 158 concentric with the rotational axis for expelling the hydraulic fluid from the port plate. Seal 160 is disposed between the outlet cover and port plate 132 for sealing the outlet cover to the port plate. Bearing 162 is installed on the tubular protrusion. The outlet cover includes cylindrical protrusion 164, port plate 132 includes cylindrical bore 166, and the cylindrical protrusion is installed in the cylindrical bore for radially positioning the second port plate relative to the outlet cover.

Bearing 168 is installed in the eccentric pocket for rotatably supporting the shaft, and bearing 170 is installed in housing 152 for rotatably supporting the eccentric pocket. Seal 172 is installed in the eccentric pocket axially between bearing 170 and the outer gerotor, for sealing the eccentric pocket to the housing.

In the embodiment shown in FIG. 1, split power gerotor pump 100 includes electric motor 174 fixed to the housing by bolts 176, for example, and drivingly engaged with the shaft. Seal 178 seals the housing to the electric motor. Outer surface 120 of the eccentric pocket includes toothed profile 180 arranged for direct engagement with the gear (not shown). That is, the toothed profile and the gear have complementary teeth that mesh together to drive the eccentric pocket when the gear is rotated. The gear may be driven by a combustion engine, for example, to operate the split power gerotor pump when the engine is running and prevent rotation of the eccentric pocket when the engine is stopped.

Figure 3:
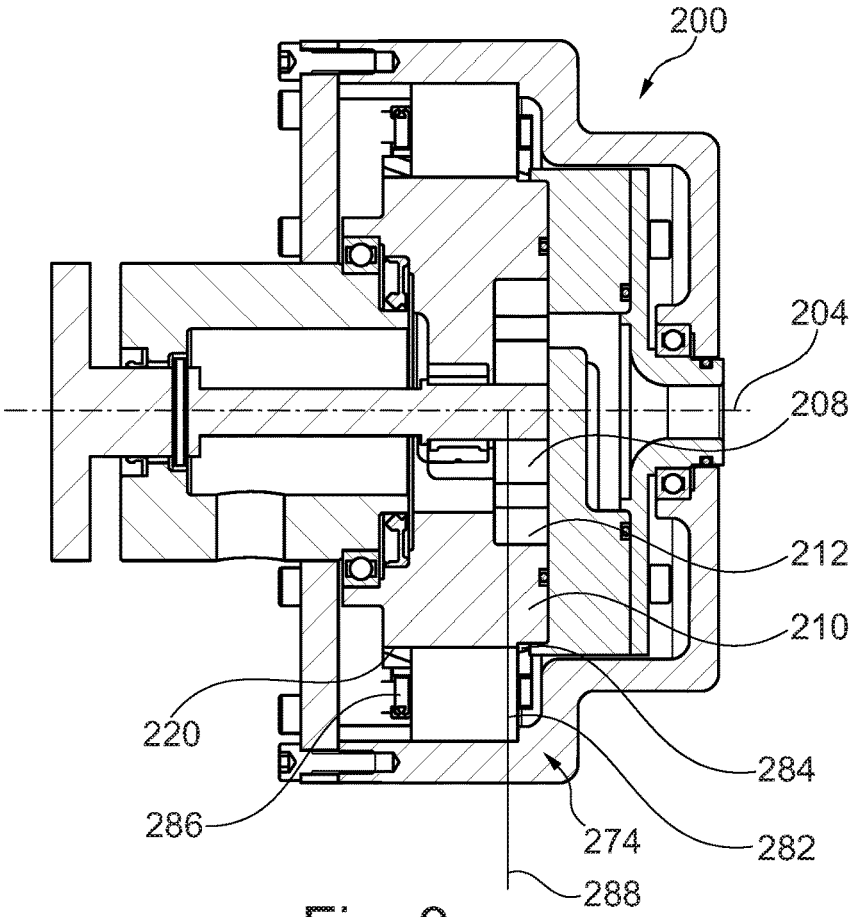
FIG. 3 illustrates a cross-sectional view of a second embodiment of a split power gerotor pump according to an example aspect of the present disclosure.

The following description is made with reference to FIG. 3. FIG. 3 illustrates a cross-sectional view of split power gerotor pump 200 according to an example aspect of the present disclosure. The above description of split power gerotor pump 100 generally applies to split power gerotor pump 200 and 2XX reference numerals correspond to 1XX reference numerals, except as described below. Electric motor 274 includes stator 282 rotationally fixed to the housing and rotor 284 rotationally fixed to outer surface 220 of eccentric pocket 210. Stator 282 includes stator coils 286. Stator 282 may be a magnetic stator and rotor 284 may be a magnetic rotor, for example. As shown in FIG. 3, straight line 288 extends radially outward from rotational axis 204 through, in order, inner gerotor 208, outer gerotor 212, rotor 284 and stator 282.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

REFERENCE NUMERALS

100 Split power gerotor pump
102 Gerotor pump assembly
104 Rotational axis
106 Shaft
108 Inner gerotor
110 Eccentric pocket
112 Outer gerotor
114 Ground flats (shaft)
116 Cylindrical bore
118 Center (cylindrical bore)
120 Outer surface (eccentric pocket)
122 Cylindrical outer surface (outer gerotor)
124 Lobes (inner gerotor)
126 Lobes (outer gerotor)
128 Port plate (first)
130 Axial side (first)

132 Port plate (second)
134 Axial side (second, opposite first)
136 Orifice (port plate 128)
138 Gap
140 Lobe (inner gerotor)
142 Lobe (outer gerotor)
144 Orifice (port plate 132)
146 Seal (first)
148 Annular face (first)
150 Annular face (second)
152 Housing
154 Collection chamber
156 Outlet cover
158 Tubular protrusion (outlet cover)
160 Seal (second)
162 Bearing (first)
164 Cylindrical protrusion (outlet cover)
166 Cylindrical bore (port plate 132)
168 Bearing (second)
170 Bearing (third)
172 Seal (third)
174 Electric motor
176 Bolts (electric motor to housing)
178 Seal (fourth)
180 Toothed profile (outer surface 120)
200 Split power gerotor pump
204 Rotational axis
208 Inner gerotor
210 Eccentric pocket
212 Outer gerotor
220 Outer surface (eccentric pocket)
274 Electric motor
282 Stator
284 Rotor
286 Stator coils
288 Straight line

What is claimed is:

1. A split power gerotor pump, comprising:
a rotational axis;
a shaft;
an inner gerotor:
rotationally fixed on the shaft;
rotatable about the rotational axis; and
comprising n first lobes;
an eccentric pocket:
rotatable about the rotational axis; and
comprising:
a cylindrical bore with a center radially offset from the rotational axis; and
an outer surface, disposed radially outside of the cylindrical bore and arranged for direct engagement with:
a gear; or
a rotor for an electric motor; and
an outer gerotor driven by the inner gerotor, the outer gerotor comprising:
a cylindrical outer surface installed in the cylindrical bore; and
n+1 second lobes.

2. The split power gerotor pump of claim 1 further comprising:
a first port plate:
fixed to the eccentric pocket on a first axial side; and
comprising a first orifice for directing a hydraulic fluid into a gap between a one of the n first lobes and a one of the n+1 second lobes; and
a second port plate:
fixed to the eccentric pocket on a second axial side, opposite the first axial side; and
comprising a second orifice for receiving the hydraulic fluid after relative rotation between the inner gerotor and the outer gerotor compresses the gap.

3. The split power gerotor pump of claim 2 wherein a one of the first port plate or the second port plate is integrally formed with the eccentric pocket from a same piece of material.

4. The split power gerotor pump of claim 3 further comprising a first seal that seals a first annular face of the other one of the first port plate or the second port plate to a second annular face of the eccentric pocket.

5. The split power gerotor pump of claim 2 further comprising a housing comprising a collection chamber hydraulically connected to the first orifice and arranged for hydraulic connection to a hydraulic sump.

6. The split power gerotor pump of claim 5 wherein the shaft extends through an axial entirety of the collection chamber.

7. The split power gerotor pump of claim 2 further comprising:
an outlet cover fixed to the second port plate and comprising a tubular protrusion concentric with the rotational axis for expelling the hydraulic fluid; and
a second seal disposed between the outlet cover and the second port plate for sealing the outlet cover to the second port plate.

8. The split power gerotor pump of claim 7 further comprising a first bearing installed on the tubular protrusion, wherein:
the outlet cover comprises a cylindrical protrusion;
the second port plate comprises a cylindrical bore; and
the cylindrical protrusion is installed in the cylindrical bore for radially positioning the second port plate relative to the outlet cover.

9. The split power gerotor pump of claim 8 further comprising a second bearing installed in the eccentric pocket for rotatably supporting the shaft.

10. The split power gerotor pump of claim 9 further comprising:
a housing; and
a third bearing installed in the housing for rotatably supporting the eccentric pocket.

11. The split power gerotor pump of claim 10 further comprising a third seal installed in the eccentric pocket axially between the third bearing and the outer gerotor for sealing the eccentric pocket to the housing.

12. The split power gerotor pump of claim 1 further comprising:
a housing; and
an electric motor.

13. The split power gerotor pump of claim 12 wherein the electric motor is fixed to the housing and drivingly engaged with the shaft.

14. The split power gerotor pump of claim 13 further comprising a fourth seal for sealing seal the housing to the electric motor.

15. A split power gerotor pump, comprising:
a rotational axis;
a shaft;
an inner gerotor:
rotationally fixed on the shaft;
rotatable about the rotational axis; and
comprising n first lobes;
an eccentric pocket:
rotatable about the rotational axis; and comprising:

a cylindrical bore with a center radially offset from the rotational axis; and an outer surface:

disposed radially outside of the cylindrical bore; and comprising a toothed profile arranged for direct engagement with a gear; and an outer gerotor comprising:

a cylindrical outer surface installed in the cylindrical bore; and n+1 second lobes; and a housing; and an electric motor fixed to the housing and drivingly engaged with the shaft.

16. A split power gerotor pump, comprising:

a rotational axis;

a shaft;

an inner gerotor:

rotationally fixed on the shaft;

rotatable about the rotational axis; and comprising n first lobes;

an eccentric pocket:

rotatable about the rotational axis; and comprising:

a cylindrical bore with a center radially offset from the rotational axis; and an outer surface disposed radially outside of the cylindrical bore; and an outer gerotor comprising:

a cylindrical outer surface installed in the cylindrical bore; and n+1 second lobes; and a housing; and an electric motor comprising:

a stator rotationally fixed to the housing and comprising a plurality of stator coils; and a rotor rotationally fixed to the outer surface of the eccentric pocket.

17. The split power gerotor pump of claim 16 wherein the stator is a magnetic stator and the rotor is a magnetic rotor.

18. The split power gerotor pump of claim 16 wherein a straight line extending radially outward from the rotational axis passes through, in order, the inner gerotor, the outer gerotor, the rotor and the stator.

* * * * *